United States Patent [19]

Gerhard et al.

[11] 4,314,512

[45] Feb. 9, 1982

[54] DAMPED SUSPENSION SYSTEM FOR CONVEYORS

[75] Inventors: Thomas Gerhard, Hirschberg-Leutershausen; Ulrich Giesen, Krefeld, both of Fed. Rep. of Germany

[73] Assignee: Waggonfabrik Uerdingen AG, Krefeld, Fed. Rep. of Germany

[21] Appl. No.: 135,620

[22] Filed: Mar. 31, 1980

[30] Foreign Application Priority Data

Apr. 14, 1979 [DE] Fed. Rep. of Germany ..... 2915236

[51] Int. Cl.[3] ..... B61B 13/04; B61B 13/02

[52] U.S. Cl. ..... 105/149; 104/89; 104/94

[58] Field of Search ..... 104/94, 89, 108; 105/153, 155, 148, 149

[56] References Cited

U.S. PATENT DOCUMENTS 3,106,171 10/1963 Julien ..... 105/149
3,525,306 8/1970 Edel et al. ..... 105/149
3,543,687 10/1970 Ellzey ..... 105/149
3,915,093 10/1975 Barthalon et al. ..... 105/149

*Primary Examiner*—Richard A. Bertsch
*Attorney, Agent, or Firm*—Michael J. Striker

[57] ABSTRACT

A damped suspension system for conveyors which has a pair of shock absorbers each of which is associated with an initial stressed spring thereby exerting a balancing effect. In preferred embodiments the shock absorbers are provided with means comprising, for example, a casing and a sleeve wherein the cylinder is executing and up and down movement relative to the sleeve. Casing and sleeve each supporting one end of the spring during movement of the conveyer in a straight line. Since, during an inclination of the cabin of the conveyor, both ends of the spring located on the lower side of the cabin are supported only through the casing, there is no possibility of a releasing. Thereby at least the initial force of the spring located on the raised side of the cabin is effective for a reset of the cabin into its vertical position.

7 Claims, 6 Drawing Figures

DAMPED SUSPENSION SYSTEM FOR CONVEYORS

BACKGROUND OF THE INVENTION

The present invention relates to a damped suspension system for reducing transverse swinging of an element depending from an overhead carrier cable while the element is moving forwardly in a straight line, and for limiting the inclination thereof relative to the cable. More particularly, this invention concerns an overhead trolley for conveyance of passengers in cities.

There is the requirement to avoid the inclinations of a cabin of the overhead trolley when moving forwardly in a straight line. This inclination caused, for example, by unilateral load or cross-wind, is very inconvenient for passengers, and moreover, it is undesired because of the resulting necessity to arrange stationary parts adjacent to the straight line track, e.g. stops, at a greater distance to the outline of the cabin. This, however, results in problems since it is difficult to keep the cabin in a vertical position which is necessary for the passengers to get on board. On the other hand, the observance of a certain pivoting angle of the cabin in curves is prescribed. To meet this requirement, there are arranged several stops on the cabin and on the undercarriage. This leads, however, to the difficulty that in the moment of a colliding of the respective stops, a lateral impact acts on the cabin which is transferred to the passengers, which impact must be avoided in consideration of the comfort of the passengers, or at least reduced.

The West German Published Application OS No. 24 38 570 discloses a damped suspension which tries to solve the mentioned problems by providing a blockable device (e.g. hydraulic shock absorber) which cooperates with the cabin and a carrying rod connected to the undercarriage. The operation of the hydraulic shock absorber is caused by a centrifugal measuring device which is arranged within or at the cabin and consists of a pendulum freely moving transversely to the direction of movement, and of two switches. When the conveyor is passing a curve, the pendulum is swinging out according to the centrifugal force and releases the blocking of the device by closing the respective switch. Therefore, a swinging movement of the cabin is obtained which movement is simultaneously dampened by the device. Through this arrangement, a stabilization of the cabin is achieved during a stop of the overhead trolley and during a movement in straight line when a one-sided load or cross wind occur. Furthermore, this reference discloses a further development of the blockable device as mechanical drive which is controlled by a centrifugal measuring device wherein a pressure scale is interposed and thereby causing a swinging of the cabin during the movement in a curved track. Therefore, a colliding of the stops on the cabin and on the carrier can be kept within the scope of the admissible end acceleration of 1 $m/sec^2$.

This principle is rather sound, however, the structural solutions for carrying out the principle into effect are rather complicated and expensive. They require the use of a centrifugal measuring device, a control line and magnetic valve according to FIG. 1 of the published application; and of a centrifugal measuring device, pressure scale, hydraulic lines, and a mechanical drive, according to FIG. 3 of the application.

This is clearly undesirable, not only because the increased manufacturing expenses reflect unfavorably on the stability of the machine, but also because the relative complexity of these constructions tends to make them susceptible to malfunction which in turn undesirably increases maintenance expenses.

SUMMARY OF THE INVENTION

Accordingly, it is an object of the present invention to overcome the disadvantages of the prior art.

A more particular object of the invention is to provide a damped suspension having an arrangement for the stabilization of a cabin of an overhead trolley during the movement thereof in a straight line as well as for a limitation of the inclination of the cabin during movement in curved tracks.

Another object of the invention is to provide such an apparatus wherein the aforementioned arrangement is of very simple and inexpensive construction.

Still a further object of the invention is to provide a damped suspension wherein the arrangement mentioned above operates on a purely mechanical basis.

A concomitant object of the invention is to provide such an arrangement as mentioned hereinbefore which is highly reliable and requires only minimal servicing and upkeep.

Pursuant to the above objects, and to others which will become apparent hereafter, a feature of the invention resides in a damped suspension system which, briefly stated, comprises a pair of shock absorbers each associated to an undercarriage and connected to the element; and a pair of prestressed springs associated with one of the shock absorbers to act in parallel therewith and exerting a force on the element for compensating swinging motions thereof.

The novel features which are considered as characteristic for the invention are set forth in particular in the appended claims.

Through the provision of the damped suspension according to the present invention, there is achieved an essential reduction of the manufacturing expenses, especially in one embodiment where only two parts (shock absorber, coil spring) are used. This arrangement is advantageously to be used where hinges for the stabilization elements and damping elements are provided for the cabin and undercarriage.

Moreover, the damped suspension according to the invention is characterized by its simple and robust construction whereby a small susceptance and better reliability of operation is obtained. Through this suspension, an essential reduction of the pendulum oscillation is achieved during a movement in straight line sections and by one-sided load. According to another embodiment, these oscillations are avoided almost completely. During the inclination of the cabin, especially during curvilinear movements, a steady build-up of force occurs in the spring located at the side of the cabin which is raised. Since the final force of the spring corresponds to the end transversal acceleration, no colliding of the stops at the undercarriage and at the cabin occurs under regular operating conditions so that a lateral impact on the cabin and therefore on the passengers is prevented.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
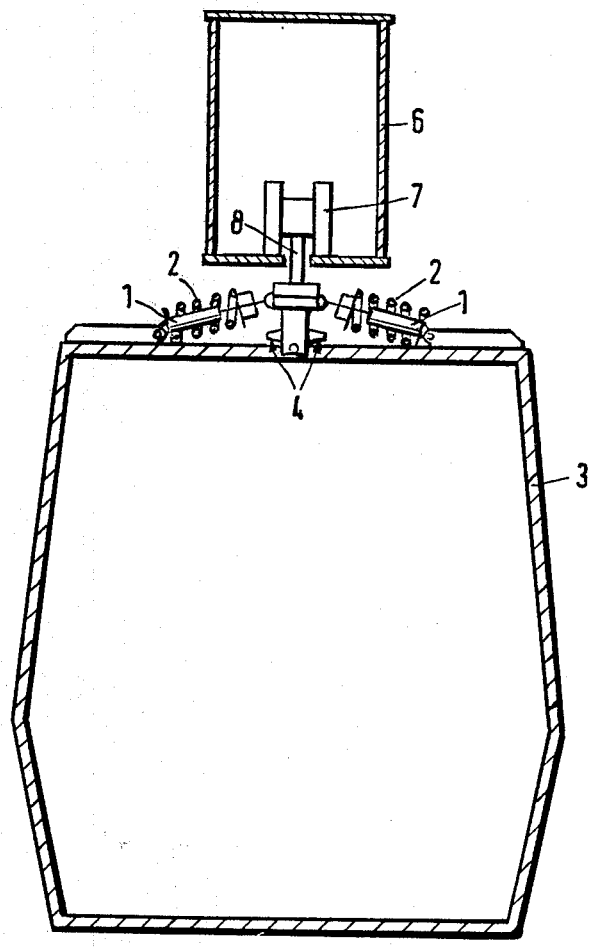
FIG. 1 is a first embodiment showing an overhead trolley, having a damped suspension according to the invention.
Figure 2:
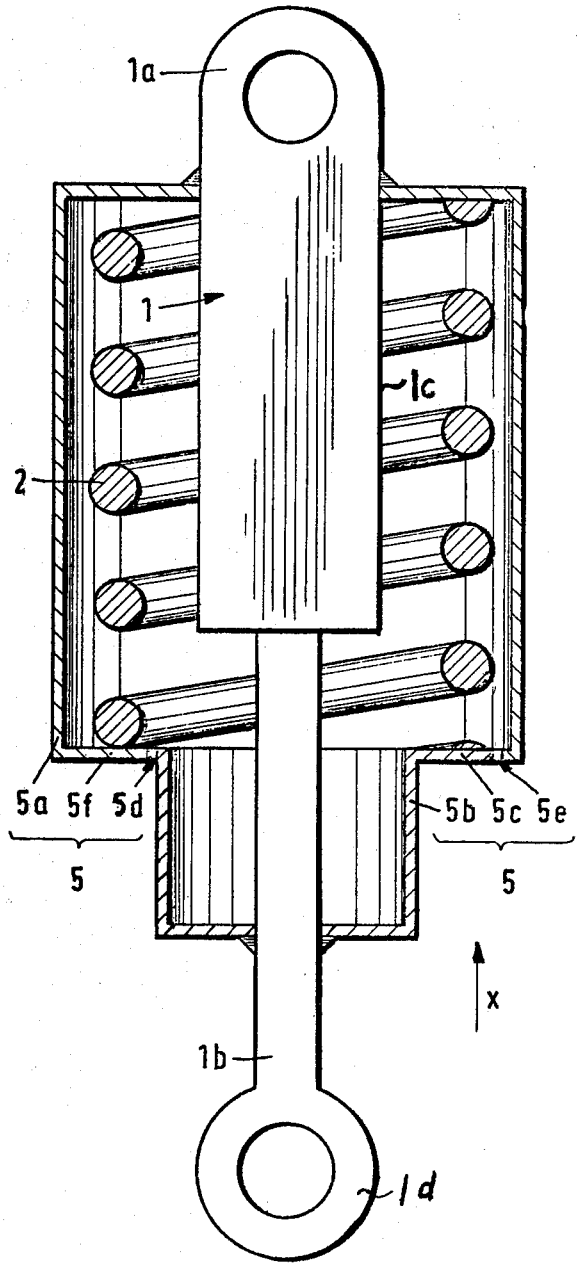
FIG. 2 is a sectional view of a second embodiment of a damped suspension system, according to the invention along the line II—II in FIG. 3 on an enlarged scale in comparison to FIG. 1 wherein the illustration of an overhead trolley is omitted.
Figure 3:
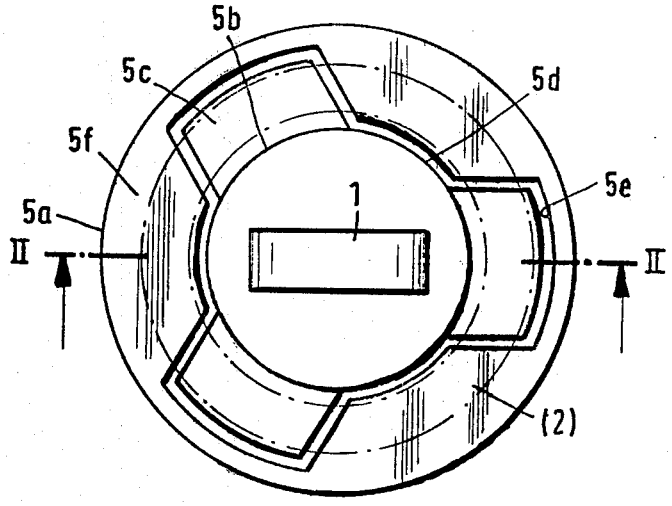
FIG. 3 is a view according to the direction of the arrow X in FIG. 2.
Figure 4:
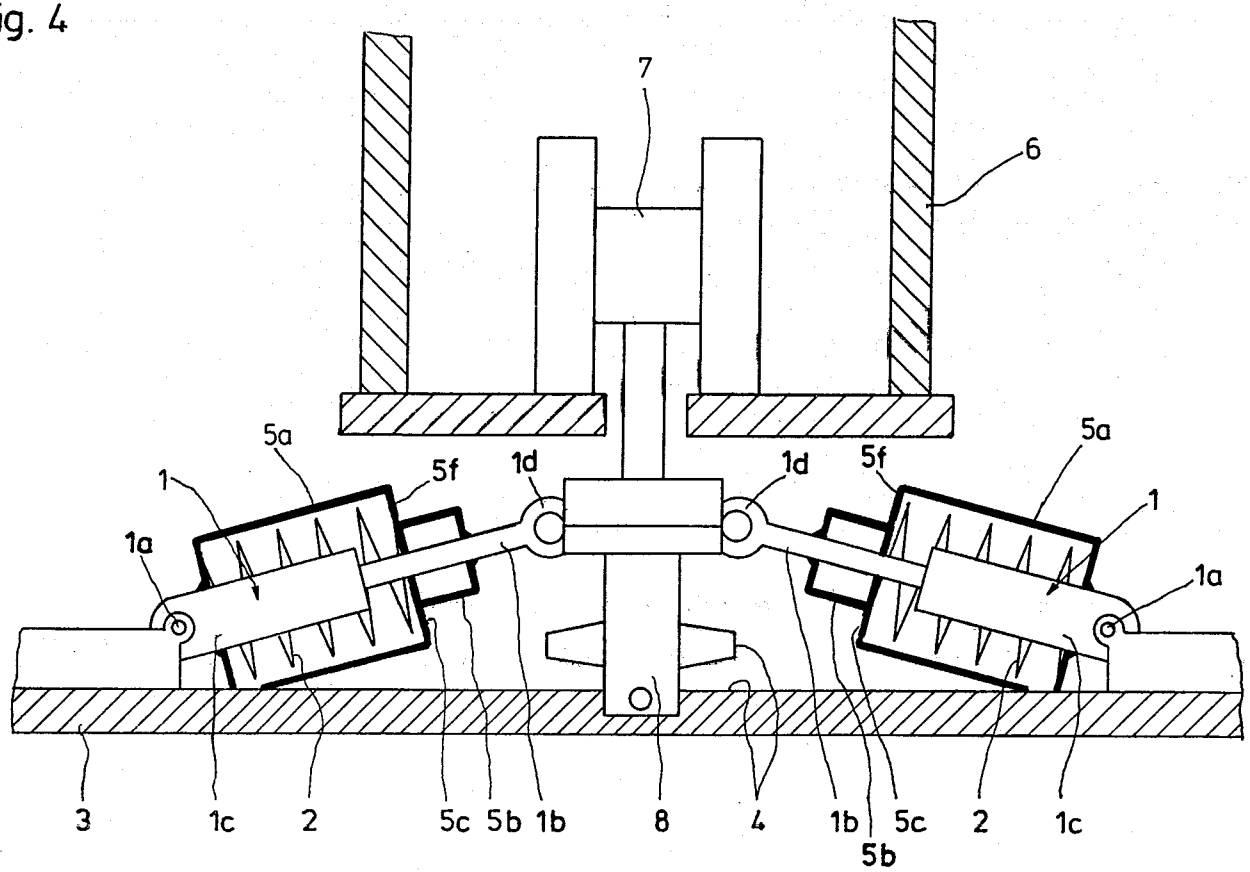
FIG. 4 shows the second embodiment of the damped suspension system attached to the overhead trolley of FIG. 1.
Figure 5:
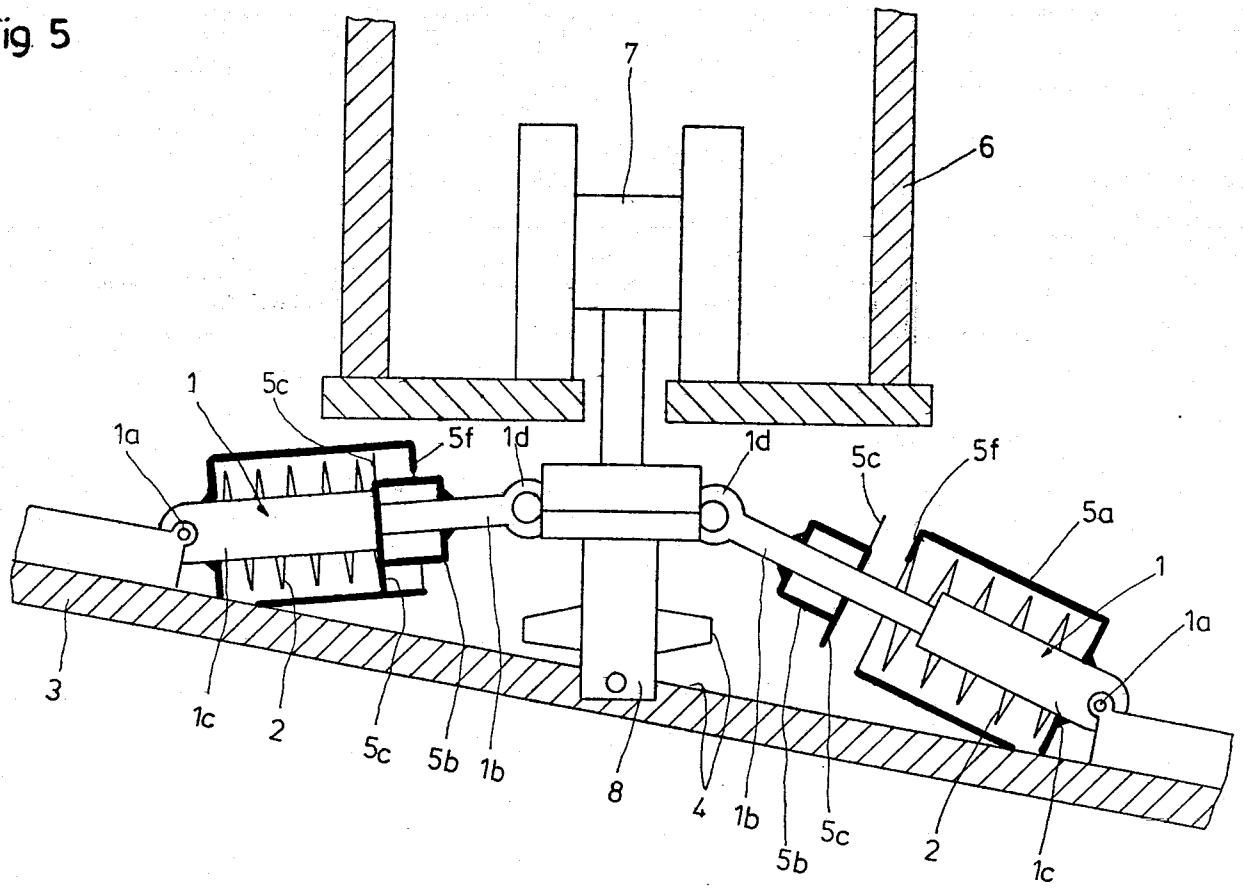
FIG. 5 shows the damped suspension system according to FIG. 4 when the overhead trolley is in an inclined position.

FIG. 1 illustrates one embodiment of the damped suspension according to the present invention, wherein an overhead trolley has essentially a track carrier 6, an undercarriage 7 guided in the track carrier and including a carrying rod 8 to which a cabin 3 is connected swingable in a direction perpendicular to the straight on movement. Stops 4 are provided on the carrying rod 8 which stops cooperate with stops located respectively on the cabin only during irregular operational conditions. Articulated to the carrying rod 8 and the cabin 3 are two shock absorbers 1. To each of the shock absorbers 1, there is hinged a spring 2 which is in form of a coil spring. The springs have the same initial stress and act parallel with the shock absorber 1.

Through these springs 2, pendulum oscillations are reduced during the movement in a straight line and inclined positions are minimized when a one-sided load occurs. The springs 2, which are both constructed in the same way, act in a balancing manner thereby obtaining a stabilization of the cabin 3. During an inclination of the cabin 3, for example, during a movement in a curved track portion, the force of the one spring 2 located on the raised side of the cabin is increasing whereas the force of the other spring 2 located on the lower side of the cabin 3 is diminishing by the amount of the build-up of the force in the one spring 2. For example, when the initial stress force of each of the springs 2 is 1,000 kp and a centrifugal force is acting upon a movement in a curved track portion or upon occurance of a one-sided load, an increasing of the force in the one spring amounts to 200 kp while the force in the other spring is diminished by 200 kp so that the difference, in this example 1,200 kp − 800 kp = 400 kp, is effective for a reset of the cabin 3 into its vertical position.

FIGS. 2, 3, 4 and 5 illustrate a further embodiment of the damped suspension which is especially suitable for preventing pendulum oscillations during the movement in a straight line and for preventing inclined positions when a one-sided load occurs and differs from that of FIG. 1 essentially in that the shock absorber 1 and the spring 2 are surrounded by a casing 5*a*. As can be seen especially in FIG. 2, the shock absorber has a piston 1*b* sliding in a cylinder 1*c* and including integrally a fixing ring 1*d* at the one end of the piston which is not sliding in the cylinder 1*c*. On the other end of the shock absorber 1, opposite to the fixing ring 1*d* of the piston 1*b*, an eye 1*a* is provided in axial elongation of the cylinder 1*c*. The casing 5*a* is fixed to the cylinder 1*c* of the shock absorber 1 in the vicinity of the eye 1*a* and receives the one end of the spring 2. The other end of the spring 2 is supported under initial stress by a sleeve 5*b* and the casing 5*a* in a manner to be described. The sleeve 5*b* is fixed to the piston 1*b* of the shock absorber 1, and is provided with a plurality of tongues 5*c* projecting radially outwardly from the sleeve 5*b*. The tongues 5*c* are spaced around the sleeve 5*b* thereby defining a plurality of recesses 5*d*, each of which being in between two respective tongues 5*c*. The tongues 5*c* and the so-formed recesses 5*d* cooperate with the casing 5*a* in such a manner that each of the tongues 5*c* is projecting in a respective recess 5*e* of the casing 5*a*. The recesses 5*e* are defined by a plurality of tongues 5*f* inwardly projecting from the casing 5*a* wherein each recess 5*e* is defined by two adjacent tongues 5*f*. Each of the tongues 5*f* is thus also projecting into the respective recess 5*d* of the sleeve 5*b*. Consequently, the other end of the spring is simultaneously supported by the tongues 5*c* of the sleeve 5*b* and the tongues 5*f* of the casing 5*a*. This embodiment operates differently from the first embodiment in such a manner that during an inclination of the cabin 3, the spring 2 which is located on the lower side becomes ineffective since the sleeve 5*b* moves away from the casing 5*a* and the spring is only supported by the tongues 5*f* of the casing 5*a* (see FIG. 5, right shock absorber) and therefore there is no possibility of a releasing of the aforesaid spring 2. At the same time, the force of the spring 2 is increased beyond its initial stressing force on the raised side of the cabin 3 since the sleeve 5*b* is moved into the casing 5*a* whereby the other end of the spring 2 is supported only by the tongues 5*c* (see FIG. 5, left shock absorber). When the initial stress force of each spring 2 is, as already mentioned, for example 1000 kp, the spring 2 of the raised side is thus effective already at the beginning of an inclination, e.g. by one-sided load, since the spring 2 at the lower side cannot exert any force, i.e. becomes ineffective immediately. Consequently, a high force is already effective upon very small oscillations thereby avoiding almost completely any pendulum oscillations of the cabin 3 during the movement in straight line.

It is to be noted, however, that a swinging motion of the cabin 3 which is achieved during a movement of the overhead trolley in curved track portions and is desired in view of the comfort of passengers is obtained nevertheless since the centrifugal force is much higher than a force exerted during one-sided load.

Figure 6:
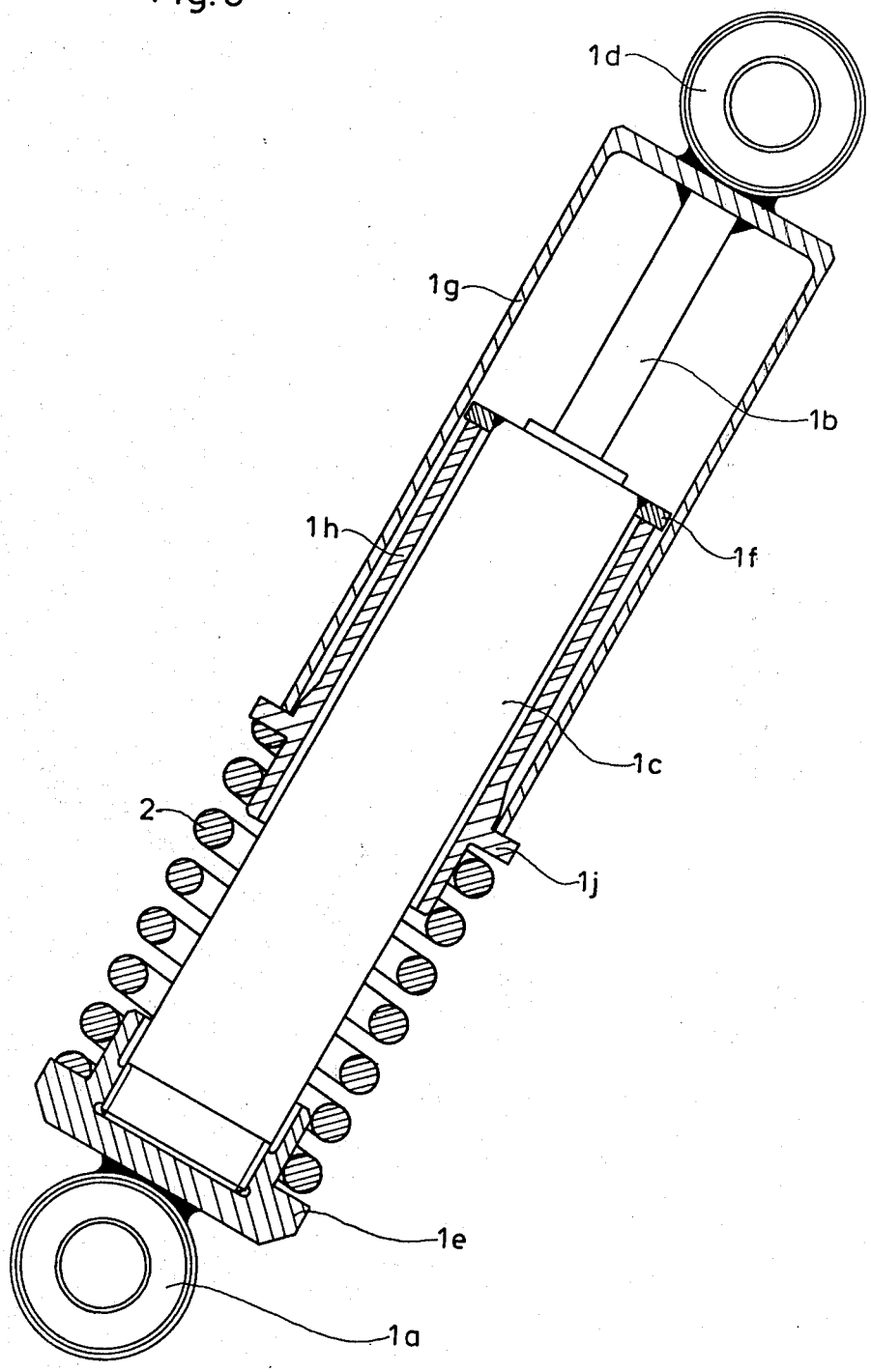
FIG. 6 is a sectional view of a third embodiment of a damped suspension system according to the invention.

FIG. 6 illustrates a third embodiment of the present invention. According to this embodiment, the cylinder 1*c* of the shock absorber 1 has one end adjacent to the ring 1*d*, provided with a first flange portion 1*f* through welding, and another end provided with a second flange portion 1*e*. The flange portion 1*f* is supporting one end of a tube 1*h* which is extending axially to the cylinder 1*c* thereby surrounding a major part of the cylinder 1*c*. In the vicinity of the other end of the tube 1*h*, a third flange portion 1*j* is integrally provided which is outwardly projecting. The flange portion 1*j* has an upper face which is supporting one end of a casing member 1*g*. The casing member 1*g* is extending axially to the cylinder 1*c* and has another end fixed to the piston 1*b* adjacent to the fixing ring 1*d*. Consequently, the casing member 1g is surrounding the tube 1h. The bottom side of the flange portion 1j is supporting one end of the spring 2 whose other end is abutting the second flange portion 1e and which is under initial stress.

This embodiment operates as follows:

When the cabin is in a straight line motion, the tube 1h is abutting the first flange portion 1f and the casing member 1g rests on the flange portion 1j of the tube 1h when no oscillations occur. During an inclination of the cabin 3, however, the shock absorber located on the raised side of the cabin is acting in such a manner that the piston 1b is sliding into the cylinder 1c thereby disconnecting the tube 1h from the first flange position 1f since the casing member 1g is moving the tube 1h relative to the cylinder 1c counter the force of the spring 2. Consequently, the force of that spring 2 is increased beyond its initial stress force, for example 1000 kp+200 kp. Simultaneously, the spring 2 provided within the shock absorber on the lower side of the cabin becomes ineffective since the piston 1b is sliding in opposite direction out of the cylinder 1c whereby the casing member 1g is disconnected with the flange portion 1j so that the tube 1h is only abutting the first flange portion 1g. Thus the spring 2 located on the lower side of the cabin cannot exert any force on the cabin.

It will be understood that each of the elements described above, or two or more together, may also find a useful application in other types of constructions differing from the types described above.

While the invention has been illustrated and described as embodied in a damped suspension system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A damped suspension system for reducing transverse swinging of an element having an undercarriage and depending from an overhead carrier cable while the element is moving forwardly in a straight line and for limiting lateral inclination thereof relative to the carrier cable, comprising a pair of shock absorbers associated to the undercarriage and connected to the element; and a pair of prestressed springs each associated with one of said shock absorbers to act in parallel therewith and exerting a force on the element for compensating swinging motions thereof.

2. A suspension system as defined in claim 1; further comprising means associated to each of the two springs are actuating the respective spring in such a manner that upon an inclination of the element the one spring associated to the shock absorber located on the raised side of the element, exerts a force beyond its initial stress and the other spring of the shock absorber located on the lowered side of the element, becomes ineffective, wherein the shock absorber has a cylinder and a piston sliding in the cylinder.

3. A suspension system as defined in claim 2, wherein the shock absorber and the spring are surrounded by a cylindrical casing having an upper face fixed to the cylinder and a bottom face so developed as to have inwardly projecting tongues at a distance to each other, two respective tongues defining a recess in between.

4. A damped suspension system for reducing transverse swinging of an element having an undercarriage and depending from an overhead carrier cable while the element is moving forwardly in a straight line and for limiting lateral inclination thereof relative to the carrier cable, comprising a pair of shock absorbers associated to the undercarriage and connected to the element; a pair of prestressed springs each associated with one of said shock absorbers to act in parallel therewith and exerting a force on the element for compensating swinging motions thereof; means associated to each of the two springs for actuating the respective spring in such a manner that upon an inclination of the element the one spring associated to the shock absorber located on the raised side of the element, exerts a force beyond its initial stress and the other spring of the shock absorber located on the lowered side of the element, becomes ineffective, wherein the shock absorber has a cylinder and a piston sliding in the cylinder; the shock absorber and the spring being surrounded by a cylindrical casing having an upper face fixed to the cylinder and a bottom face so developed as to have inwardly projecting tongues at a distance to each other, two respective tongues defining a recess in between; and wherein the bottom face of the casing is cooperating with a sleeve having a bottom side fixed to the piston and an upper side provided with outwardly projecting tongues at a distance to each other, wherein two respective tongues define a recess in between, in such a manner that the tongues of the casing are projecting into the respective recesses of the sleeve and the tongues of the sleeve are projecting into the respective recesses in the casing so that the spring is encased by the casing and the sleeve.

5. A suspension system as defined in claim 4, wherein the spring has one end supported by the upper face of the casing and another end supported by the tongues of the casing and the sleeve.

6. A damped suspension system for reducing transverse swinging of an element having an undercarriage and depending from an overhead carrier cable while the element is moving forwardly in a straight line and for limiting lateral inclination thereof relative to the carrier cable, comprising a pair of shock absorbers associated to the undercarriage and connected to the element; a pair of prestressed springs each associated with one of said shock absorbers to act in parallel therewith and exerting a force on the element for compensating swinging motions thereof; means associated to each of the two springs for actuating the respective spring in such a manner that upon an inclination of the element the one spring associated to the shock absorber located on the raised side of the element, exerts a force beyond its initial stress and the other spring of the shock absorber located on the lowered side of the element, becomes ineffective, wherein the shock absorber has a cylinder and a piston sliding in the cylinder; and wherein the cylinder is provided with an outwardly projecting first flange portion at the end through which the piston is introduced and an outwardly projecting second flange portion at the other end, the cylinder being surrounded along a major part by a tube which is abutting the first flange portion with its one end and is provided with an outwardly projecting third flange portion in the vicinity of its other end, wherein the one end of the spring is supported by the third flange portion and the other end of the spring is abutting the second flange portion.

7. A suspension system as defined in claim 6, wherein the third flange portion is supporting a casing member on the side opposite to the side abutted by the spring, the casing member surrounding the tube and being fixed to the piston so that the spring on the raised side is exerting a force beyond the initial stress force upon the inclination and the spring on the lowered side becomes ineffective.

* * * * *